US009546856B1

(12) United States Patent
Centrella et al.

(10) Patent No.: US 9,546,856 B1
(45) Date of Patent: Jan. 17, 2017

(54) PRESS LOAD PROCESS FOR WARHEAD

(71) Applicants: John Centrella, Wharton, NJ (US); John Sequeira, Jersey City, NJ (US)

(72) Inventors: John Centrella, Wharton, NJ (US); John Sequeira, Jersey City, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 192 days.

(21) Appl. No.: 14/492,351

(22) Filed: Sep. 22, 2014

(51) Int. Cl.
*F42B 33/02* (2006.01)

(52) U.S. Cl.
CPC ..... *F42B 33/0207* (2013.01)

(58) Field of Classification Search
CPC . F42B 33/025; F42B 33/0207; F42B 33/0214; F42B 33/02; C06B 21/0041
USPC .... 86/20.11–20.15, 23, 20.1, 29–31, 51, 56; 264/3.1; 419/42
See application file for complete search history.

(56) References Cited

U.S. PATENT DOCUMENTS 3,924,510 A * 12/1975 Strunk ..... F42B 1/036 264/3.1
3,961,554 A * 6/1976 Harris ..... F42B 33/0235 264/3.1
4,020,736 A * 5/1977 Petersen ..... F42B 33/025 86/20.12
4,208,945 A * 6/1980 Davegardh ..... F42B 33/025 86/20.11
4,250,792 A * 2/1981 Deigmuller ..... F42B 33/025 102/309
4,455,914 A * 6/1984 Christmann ..... F42B 33/025 102/476
4,651,618 A * 3/1987 Ringel ..... F42B 33/025 264/3.1
4,710,329 A * 12/1987 Lebas ..... B29C 43/10 102/292
4,920,079 A * 4/1990 Kaeser ..... C06B 21/0041 102/292
5,115,707 A * 5/1992 Kutzli ..... F42B 30/08 102/439
5,227,576 A * 7/1993 Howard ..... B22F 3/04 419/42
5,251,530 A * 10/1993 Kaeser ..... F42B 1/036 102/476
5,354,519 A * 10/1994 Kaeser ..... C06B 21/0041 264/3.1
2010/0229751 A1* 9/2010 Dave ..... F42B 12/76 102/473
2010/0269723 A1* 10/2010 Hugus ..... F42B 12/74 102/430
2014/0020590 A1* 1/2014 Torsten ..... F42B 33/00 102/495

* cited by examiner

*Primary Examiner* — Reginald Tillman, Jr.
(74) *Attorney, Agent, or Firm* — John P. DiScala

(57) ABSTRACT

A method of filling a projectile case with energetic material includes isostatically pressing a column of the powder to create a pre-formed billet (PFB). The single PFB is placed in and then pressed into the projectile case to create the finished warhead. The single PFB effectively fills a projectile case having a large l/d ratio. The single PFB eliminates the problems and poor quality associated with pressing multiple increments in a projectile case.

15 Claims, 3 Drawing Sheets

PRESS LOAD PROCESS FOR WARHEAD

STATEMENT OF GOVERNMENT INTEREST

The inventions described herein may be manufactured, used and licensed by or for the United States Government.

BACKGROUND OF THE INVENTION

The invention relates to press-loading energetic material into warhead projectiles.

A conventional press-loading process for a projectile uses multiple increments of powder to achieve specified quality requirements. Warhead projectiles typically are shaped with a length-to-diameter (l/d) ratio that balances ballistics and payload. When press-loading projectiles with larger l/d ratios, quality and performance issues arise due to an inherent inefficiency in pressing long charges of powder. It is known that friction forces, both inter-particle and wall-boundary, are quality factors that must be minimized during the press-loading process. Otherwise, the pressed charge will have a density gradient marked by significant degradation along its central axis and further from the press punch. Consequently, long powder charges cannot be pressed to meet density and mass specifications. The conventional pressing process relies on multiple pressed increments of powder to reduce the l/d ratio to a manageable amount.

Conventional load procedures typically require that multiple increments of powder or pre-consolidated pellets are loaded and compacted individually. For example, for a cylindrical die, efficient consolidation of energetic material is only achieved if the punch diameter is equal to or greater than the length of the container (l/d less than 1). Thus, in the conventional process, the powder is poured and pressed incrementally. Inefficient cohesion between subsequent compacted layers and sharp corners left behind upon withdrawal of the punch may cause the layers to crack and de-laminate internally. Poorly bonded layers and low-density areas manifest themselves as transverse cracks and internal voids. When a warhead is launched, the case is propelled forward while the energetic fill is forced against the back of the case under its own momentum. This phase, referred to as setback acceleration, harbors severe risk of unintended initiation as any transverse cracks in the energetic material may close violently. Conversely, with particularly insensitive compositions, a warhead may not reliably initiate if a detonation wave cannot cross these large transverse voids.

To obtain consistent quality through the entire length of a column of energetic material, each pressed increment requires a complete cycling of all the pressing steps and parameters including loading, vacuum dwell, pressure dwell, pressure cycling, and unloading. Generally, the use of fewer increments reduces the total cycle time but decreases the overall quality. A balanced process can be achieved, but throughput in a production setting is always choked by incremental press-loading.

A need exists for a faster method of press-loading energetic material that results in consistently high quality throughout the column of energetic material.

SUMMARY OF INVENTION

One aspect of the invention is a method of filling a projectile case with energetic material. The method includes providing the energetic material in a powder form. A column of the powder is isostatically pressed to create a pre-formed billet (PFB). The PFB is placed in the projectile case and pressed in the projectile case. The projectile case is filled using only one PFB.

The method may include placing the PFB in a projectile case having an l/d ratio greater than or equal to one.

The step of isostatically pressing may include only pressing the column of powder radially and not pressing the column axially.

The step of isostatically pressing may include pressing a mold in which the column of powder is disposed.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A novel method of loading energetic material in a warhead enables filling a projectile having a large l/d ratio with only a single increment of energetic material, while maintaining high quality. The method may be used to compact powders into long, closed containers, such as the warhead of a rocket or projectile.

The process relies on the use of pre-formed billets (PFBs) produced by isostatic pressing. Isostatic pressing is a technique that uses hydraulic fluid contained within a pressure vessel to generate uniform forces on a powder-filled flexible container. The flexible container is called bag tooling. In traditional isostatic presses, the bag tooling is submerged in hydraulic fluid within a pressure vessel. In newer isostatic presses, hydraulic fluid does not contact the mold directly. This method is known in industry as dry-bag isostatic pressing. Consolidation forces are applied radially to the mold. The radially applied forces compact the mold and the energetic powder uniformly along the central longitudinal axis. The compaction of the powder volume reduces its cross-sectional area in proportion to the square of the radius of the area. Isostatic pressing is an efficient method of applying compaction forces uniformly upon all exposed surfaces.

Figures 1, 2:
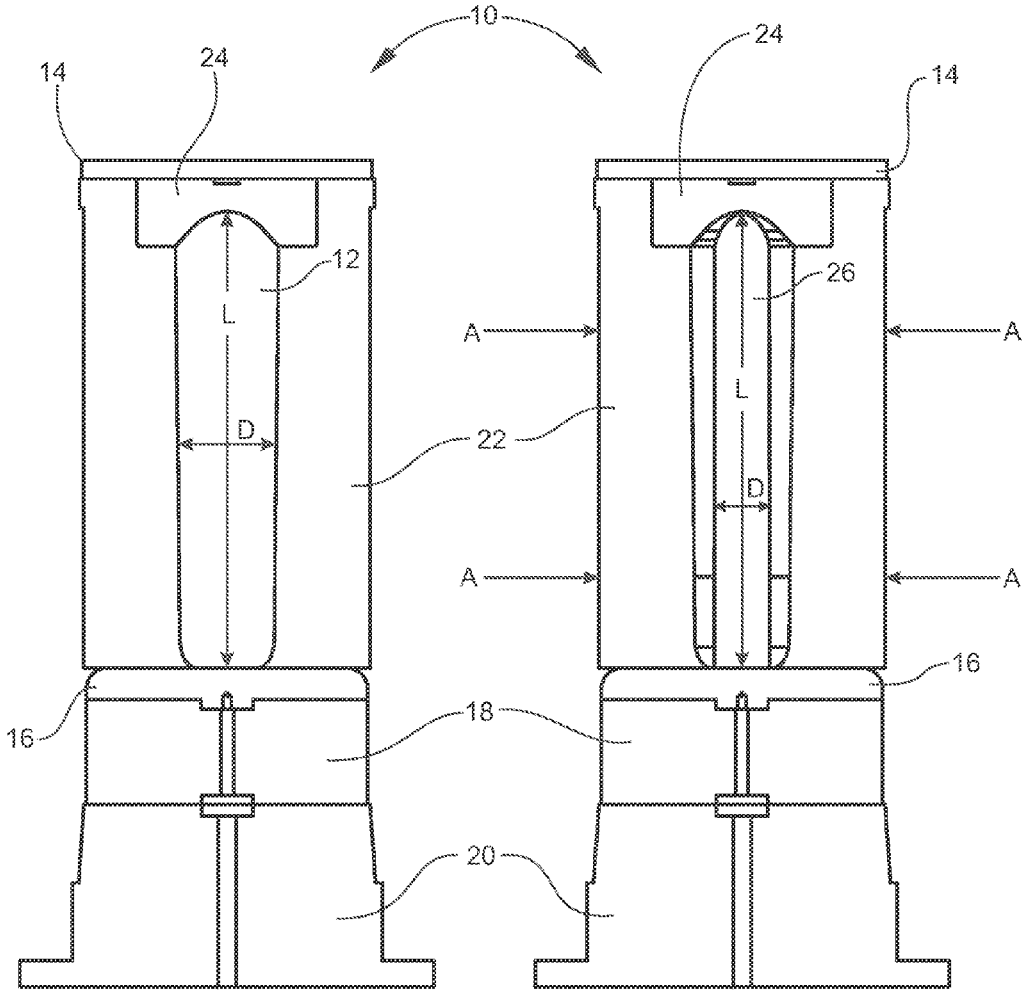
FIG. 1 is a schematic of one embodiment of an isostatic pressing tool with a column of powder to be pressed.
FIG. 2 is a schematic of the isostatic pressing tool of FIG. 1 after the column of powder has been pressed.

FIG. 1 is a schematic of an isostatic pressing tool 10 with a column 12 of powder to be pressed. The powder may be energetic material. Pressing tool 10 includes a fixed lid 14 and a base plate 16. A spacer 18 and a pressure plug 20 are disposed beneath base plate 16. A cap 24 is disposed beneath the fixed lid 14. The powder column 12 is disposed in bag tooling, for example, a low durometer polyurethane mold 22. The interior walls of the pressure vessel (not shown) are an oil-filled bladder which applies force to the mold 22 without exposing the mold 22 to the oil. Isolating the oil from the mold 22 simplifies loading and extraction of the mold 22 and enables easier automation of the isostatic pressing process.

FIG. 2 is a schematic of the isostatic pressing tool 10 after the column 12 of powder has been pressed and transformed into a pre-formed billet (PFB) 26. In FIG. 2, the arrows A represent the isostatic pressure applied to the mold 22 by hydraulic fluid. As the hydraulic fluid pressure increases, the mold 22 transfers the pressure to the powder column 12. The isostatic pressing process reduces the diameter D of the powder column 12 by, for example, about 33%, while the length L of the column 12 is unchanged. Base plate 16 and lid 14 are fixed in place to constrain axial flow of the powder in column 12.

The finished PFB 26 is strong, flat on one end, fairly straight along its central axis, and has a rough finish. The mold 22, base plate 16 and cap 24 can be designed to form a variety of shapes and features needed for press loading. The shapes and features may include, for example, ogives, domes, shoulders, bellies, etc.

In the isostatic pressing process, the pressure, temperature, vacuum level and dwell time may be controlled parameters. Pressing the PFB 26 isostatically may require known tooling made of polyurethane and metal. Because the PFB 26 is isostatically pressed on its radius, there are no density gradients along the central longitudinal axis (along the length L). PFBs 26 of almost any l/d ratio can be isostatically pressed without degrading the density consistency needed for warheads.

Figure 3:
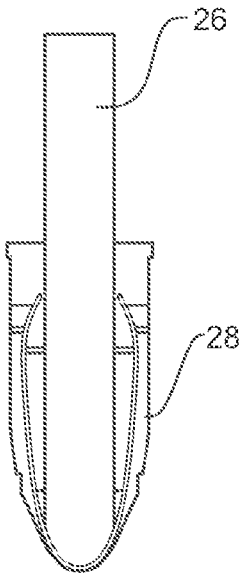
FIG. 3 is a schematic of one embodiment of a pre-formed billet disposed in a projectile case.

Once a PFB 26 has been isostatically pressed, it can be immediately loaded into a waiting projectile case 28 (FIG. 3) for final press-loading or, it can be moved into raw material inventory for future press loading. Either way, the PFB 26 is the single increment charge necessary to implement the remainder of the warhead loading process.

After the PFB 26 is isostatically pressed, conventional press tooling and platforms may be used to deform the PFB 26 inside a projectile case 28. Depending on the projectile case strength, the mechanical properties of the energetic material, and the pressing parameters, the press tooling can be designed to meet safety regulations and quality standards. In addition to the pressing parameters controlled in the isostatic pressing process, ram position may also be controlled when pressing the PFB 26 in the projectile case 28.

Well-characterized energetic material properties provide a reliable basis for developing mathematical models for predicting behavior of the column 12 of energetic material under consolidation stress. Stress fields and density mapping shown through finite element analysis (FFA) can provide insights to tooling design and press process development (time, temperature, pressure). The PFB 26 will deform under relatively low force. To fill corners of a projectile case 28 with energetic material and to raise the fill-density to near theoretical maximums, greater pressing forces may be required.

Prior to pressing the PFB 26 into an empty projectile case 28, the projectile case 28 is aligned and supported by tooling so that the projectile case 28 remains fully constrained during the pressing step. The PFB 26 may be pressed to a density of, for example, about 95% of the theoretical maximum density so that the energetic material readily deforms and flows in the projectile case void. Once the energetic material begins to flow and fills the void, its density begins to rise as the pressure increases. The deformation of the PFB 26 within the consolidation zone in the projectile case 28 is radially outward toward the case wall. The radially outward deformation minimizes wall friction and counter forces applied to the advancing press punch.

Figure 4:
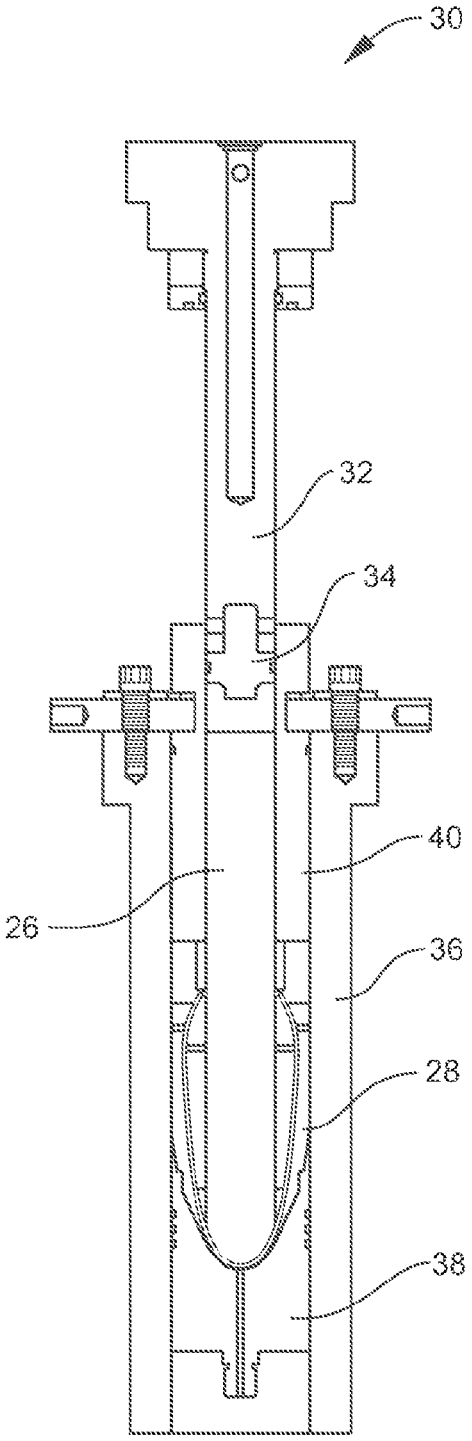
FIG. 4 is a schematic of one embodiment of a conventional press with a pre-formed billet prior to pressing in a projectile case.
Figure 5:
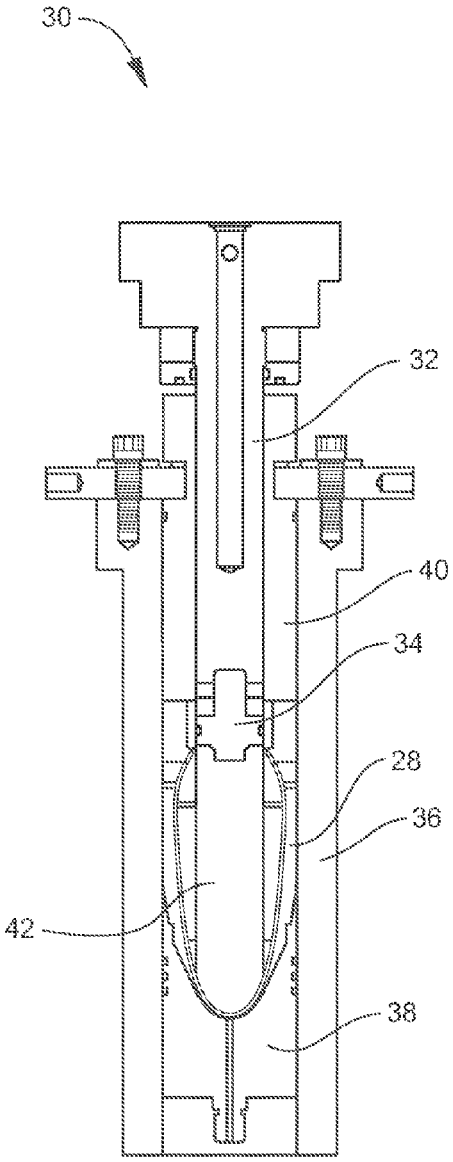
FIG. 5 is a schematic of the press of FIG. 4 after the pre-formed billet has been pressed into the projectile case.
Figure 6:
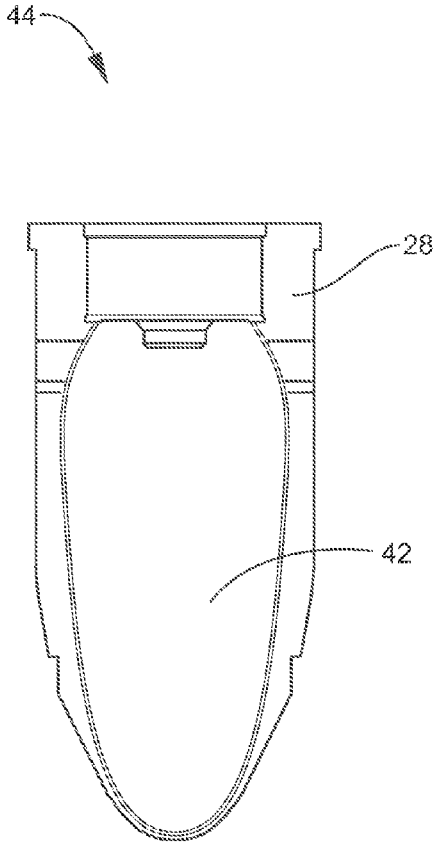
FIG. 6 is a schematic view of a finished warhead.

FIG. 4 is a schematic of one embodiment of a conventional press 30 with a pre-formed billet 26 prior to pressing in a projectile case 28. Press 30 includes a ram 32, a forming punch 34, a support die 36, a support tooling 38 and a loading sleeve 40. In this case, the PFB 26 is greater than two times the length of the void to be filled. Support tooling 38 provides alignment and support of the projectile case 28 under extreme loading forces. Forming tools such as forming punch 34 may be useful to produce desired features in the pressed charge. FIG. 5 shows the press 30 after the PFB 26 has been compacted into a pressed charge 42 in projectile case 28. FIG. 6 shows the finished warhead 44 with projectile case 28 and pressed charge 42.

The novel process has several advantages over conventional incremental powder pressing. Because only one compacted increment is loaded and pressed, the final product has no transverse cracks. A single PFB 26 can be used to press-load longer projectiles than can be pressed with prior art processes. The production time is faster. The novel process can integrate easily into conventional pressing platforms.

While the invention has been described with reference to certain embodiments, numerous changes, alterations and modifications to the described embodiments are possible without departing from the spirit and scope of the invention as defined in the appended claims, and equivalents thereof

What is claimed is:

1. A method of filling a projectile case with energetic material, comprising:

providing the energetic material in a powder form;

isostatically pressing a column of the powder to create a pre-formed billet (PFB);

placing the PFB in the projectile case wherein an interior cavity of the projectile case has a larger maximum diameter than an opening of the projectile case;

axially pressing the PFB in the projectile case thereby increasing the density of the PFB; and filling the projectile case using only the one PFB.

2. The method of claim 1, wherein placing the PFB includes placing the PFB in a projectile case having an l/d ratio greater than or equal to one.

3. The method of claim 1, wherein isostatically pressing includes only pressing the column of powder radially and not pressing the column axially.

4. The method of claim 1, wherein isostatically pressing includes pressing a mold in which the column of powder is disposed.

5. The method of claim 2, wherein placing the PFB includes placing the PFB in a projectile case having an l/d ratio greater than or equal to two.

6. The method of claim 4, wherein isostatically pressing includes pressing the mold with hydraulic fluid.

7. The method of claim 6, wherein isostatically pressing includes pressing a mold made of polyurethane.

8. The method of claim 3, wherein isostatically pressing includes reducing a cross-sectional area of the column of powder.

9. The method of claim 8, wherein isostatically pressing includes maintaining a constant length of the column of powder.

10. A method of filling a projectile case with energetic material, comprising:

providing the energetic material in a powder form;

radially isostatically pressing a column of the powder to create a pre-formed billet (PFB);

placing the PFB in the projectile case without cooling the preform, the projectile case having an l/d ratio greater than or equal to one and an interior cavity of the projectile case having a larger maximum diameter than an opening of the projectile case;

axially pressing the PFB in the projectile case thereby increasing the density of the PFB up to approximately 95% of the theoretical maximum density; and filling the projectile case using only the one PFB.

11. The method of claim 10, wherein radially isostatically pressing includes only radially isostatically pressing the column of powder.

12. The method of claim 11, wherein radially isostatically pressing includes maintaining a constant length of the column of powder.

13. The method of claim 10, wherein radially isostatically pressing includes pressing a mold in which the column of powder is disposed.

14. The method of claim 13, wherein radially isostatically pressing includes pressing the mold with hydraulic fluid.

15. The method of claim 10, wherein radially isostatically pressing includes reducing a cross-sectional area of the column of powder.

* * * * *